US006847165B2

(12) United States Patent
Sung et al.

(10) Patent No.: US 6,847,165 B2
(45) Date of Patent: Jan. 25, 2005

(54) PLASMA PANEL

(75) Inventors: Wen-Fa Sung, Hsin-Chu (TW); Shiang-Wen Wan, Taipei Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 0 days.

(21) Appl. No.: 10/707,414

(22) Filed: Dec. 12, 2003

(65) Prior Publication Data

US 2004/0251831 A1 Dec. 16, 2004

(30) Foreign Application Priority Data

Jun. 11, 2003 (TW) ..... 92115909 A

(51) Int. Cl.[7] ..... H01J 17/49
(52) U.S. Cl. ..... 313/587; 313/586
(58) Field of Search ..... 313/582–587; 315/169.4; 345/60

(56) References Cited

U.S. PATENT DOCUMENTS

| | | | | | |
|---|---|---|---|---|---|
| 5,932,967 | A | * | 8/1999 | Chikazawa | 313/582 |
| 6,326,727 | B1 | * | 12/2001 | Chung | 313/586 |
| 6,492,770 | B2 | * | 12/2002 | Amemiya et al. | 313/586 |
| 6,525,470 | B1 | * | 2/2003 | Amemiya | 313/586 |
| 6,570,339 | B1 | * | 5/2003 | Moore | 315/169.3 |
| 2001/0033483 | A1 | * | 10/2001 | Moore | 362/84 |

* cited by examiner

*Primary Examiner*—Vip Patel
*Assistant Examiner*—Glenn Zimmerman
(74) *Attorney, Agent, or Firm*—Winston Hsu

(57) ABSTRACT

A plasma panel includes a rear plate, a front plate disposed in parallel and spaced apart from the rear plate, a plurality of electrode pairs disposed in parallel with each other, and a first dielectric layer having a first predefined pattern to cover the electrode pairs. The plasma panel offers high brightness and luminous efficiency.

14 Claims, 5 Drawing Sheets

PLASMA PANEL

BACKGROUND OF INVENTION

1. Field of the Invention

The present invention generally relates to a plasma panel (PP), and more particularly, to a plasma panel having a high luminous efficiency.

2. Description of the Prior Art

Recently, various display techniques are developed flourishingly. After continuous research and development, new products, such as liquid crystal displays (LCDs), plasma display panels (PDPs), and organic light emitting diode displays (OLED displays), have been gradually commercialized and applied to various displaying apparatuses having different sizes. Nowadays, all of the manufacturers are developing toward both high brightness and high efficiency to fabricate a more commercially profitable display. Among all of the key components of the displays, the backlight used for providing a light source, such as a plasma panel, affects the total luminous efficiency of the display significantly. When the backlight has a superior luminous efficiency, not only is the brightness of the display improved, but also design flexibility and manufacturing flexibility are provided to other components in the display. When the backlight has a poor luminous efficiency, not only is the light source limited, but also the brightness of the display is not satisfied.

Referring to FIG. 1. FIG. 1 is a cross-sectional diagram of a plasma panel 10 according to the prior art. The prior art plasma panel 10 comprises a rear plate 12, and a front plate 14 disposed parallel with and spaced apart from the rear plate 12. A plurality of electrode pairs 16 are disposed on a top surface 18 of the rear plate 12. Each electrode pair 16 comprises a positive electrode 22 and a negative electrode 24. The positive electrode 22 and the negative electrode 24 of each electrode pair 16 are spaced equally, and a discharge gap is formed between the positive electrode 22 and the negative electrode 24 of each electrode pair 16. A dielectric layer 26 is disposed on the top surface 18 of the rear plate 12 to cover the electrode pairs 16 so as to protect and isolate the electrode pairs 16. A fluorescent layer 32, usually being a phosphorous layer, is coated on both a bottom surface 28 of the front plate 14 and a surface of the dielectric layer 26. A plurality of spacers 34 are disposed between the front plate 14 and the rear plate 12 to maintain the fixed spacing between the front plate 14 and the rear plate 12. In addition, a discharging gas is filled between the front plate 14 and the rear plate 12 to generate grow discharge when a voltage is applied between the positive electrode 22 and the negative electrode 24.

When a voltage is applied between the positive electrode 22 and the negative electrode 24 of each electrode pair 16, an electric field is generated between the positive electrode 22 and the negative electrode 24 to ionize the discharging gas so as to initiate discharge. Ultraviolet rays are thus generated due to energy transferring. When the ultraviolet rays shine incident on the fluorescent layer 32, the fluorescent layer 32 will emit visible lights. The factors affecting the luminous efficiency of the plasma panel 10 include the kind of the discharging gas, the material composition of the electrode, the luminous efficiency of the fluorescent material, and the area for the fluorescent material.

However, the prior art plasma panel 10 has a severe problem. Under the technical level up till now, the luminous efficiency of the plasma panel 10 can only reach to a certain extent. That means, the brightness of the plasma panel 10 usually can not come up to an expected value to affect the brightness performance of the display. Even when the brightness of the plasma panel 10 meets the expected value, the brightness of the display can not be improved and design flexibility and manufacturing flexibility of other components in the display can not be provided. Among all of the previously mentioned factors, the first three involve material selection. In other words, the adapted material is usually replaced, resulting in infeasibility when considering the cost. Especially in a production line having complicated processing steps, a slight change may involve a lot to obstruct the change. The last factor involves the structure of the plasma panel.

SUMMARY OF INVENTION

It is an object of the present invention to provide a plasma panel to improve the brightness and the luminous efficiency of the plasma panel and to avoid the above-mentioned problems.

According to one aspect of the present invention, a plasma panel comprises a rear plate, a front plate parallel with and spaced apart from the rear plate, a plurality of electrode pairs disposed in parallel with each other, and a first dielectric layer having a first predefined pattern to cover the electrode pairs.

In a plasma panel according to the present invention, a patterned dielectric layer is adapted. The coating area for the fluorescent material is thus increased greatly because of the recesses in the dielectric layer to improve the luminous efficiency of the plasma panel. Not only is the brightness of the plasma panel improved, but also the brightness of the display is improved to provide extra design flexibility and manufacturing flexibility to other components in the display. Furthermore, the problem of cost due to material replacement is not incurred. When applying the present invention plasma panel to a practical production line, the display having a high efficiency, high brightness, and low cost is fabricated.

These and other objectives of the present invention will become apparent to those of ordinary skill in the art after having read the following detailed description of the preferred embodiments illustrated in the various drawings.

DETAILED DESCRIPTION

Figure 1:
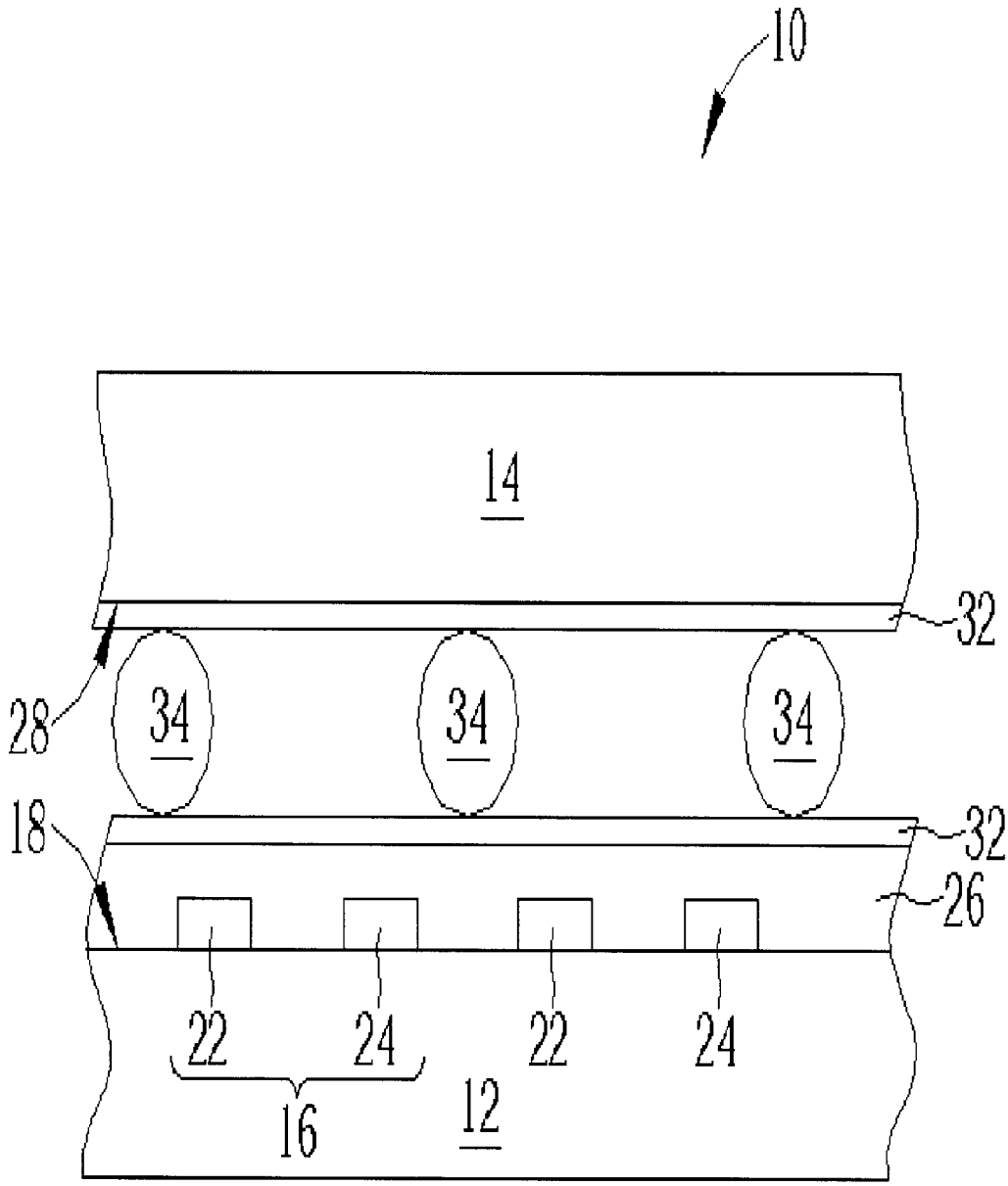
Fig. 1 Prior art
FIG. 1 is a cross-sectional diagram of a plasma panel according to the prior art.
Figure 2:
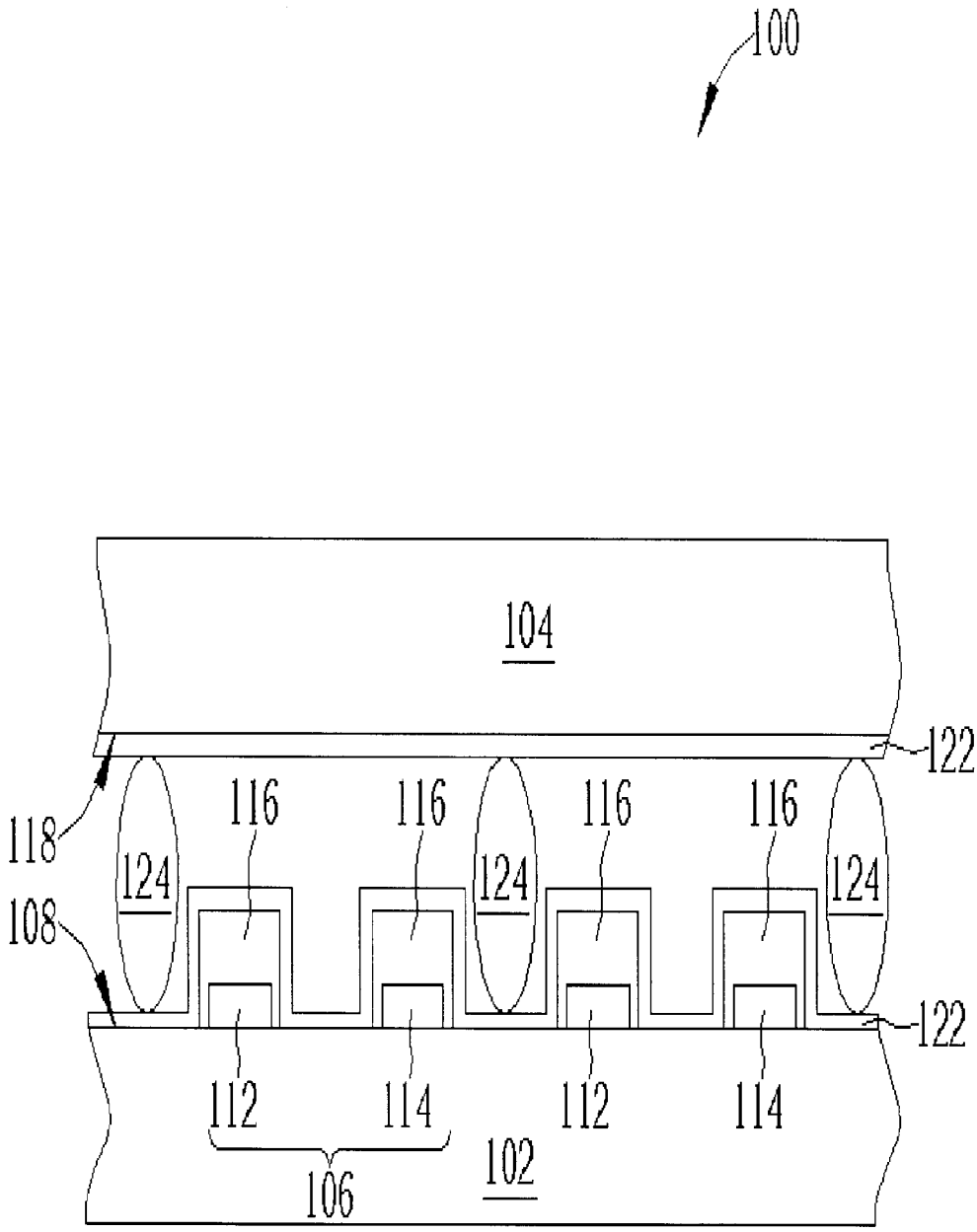
FIG. 2 is a cross-sectional diagram of a plasma panel according to a first preferred embodiment of the present invention.

The present invention provides a plasma panel having a high luminous efficiency. Referring to FIG. 2. FIG. 2 is a cross-sectional diagram of a plasma panel 100 according to a first preferred embodiment of the present invention. The present invention plasma panel 100 comprises a rear plate 102, and a front plate 104 disposed parallel with and spaced apart from the rear plate 102. A plurality of electrode pairs 106 are disposed on a top surface 108 of the rear plate 102. Each electrode pair 106 comprises a positive electrode 112 and a negative electrode 114. The positive electrode 112 and the negative electrode 114 of each electrode pair 106 are spaced equally, and a discharge gap is formed between the positive electrode 112 and the negative electrode 114 of each electrode pair 106. A dielectric layer 116 having a predefined pattern is disposed on the top surface 108 of the rear plate 102 to cover the electrode pairs 106 so as to protect and isolate the electrode pairs 106.

A fluorescent layer 122, usually being a phosphorous layer, is respectively coated on a bottom surface 118 of the front plate 104, the top surface 108 of the rear plate 102, and a surface of the dielectric layer 116. A plurality of spacers 124 are disposed between the front plate 104 and the rear plate 102 to maintain the fixed spacing between the front plate 104 and the rear plate 102. In addition, a discharging gas is filled between the front plate 104 and the rear plate 102 to generate grow discharge when a voltage is applied between the positive electrode 112 and the negative electrode 114. The discharging gas is an inert gas, such as helium (He), neon (Ne), argon (Ar), etc, or a mixed gas of these inert gases.

Figure 3:
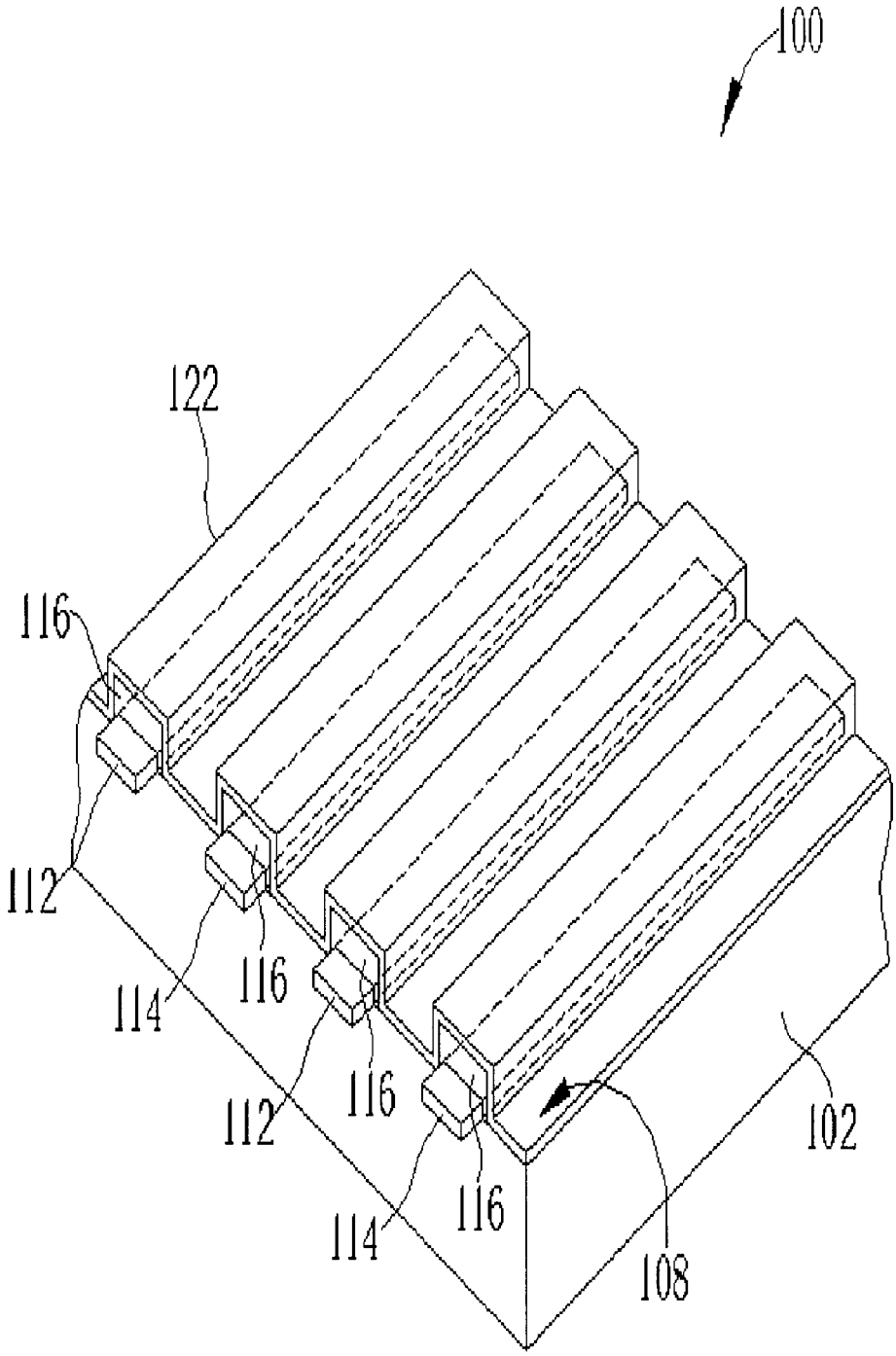
FIG. 3 is a top view of the plasma panel shown in FIG. 2.

Referring to FIG. 3. FIG. 3 is a top view of the plasma panel 100 shown in FIG. 2. As shown in FIG. 3, since the dielectric layer 116 has the predefined pattern shown in FIG. 3, the dielectric layer 116 does not cover the positive electrode 112 and the negative electrode 114 levelly. Rather, the dielectric layer 116 presents in a sequence of a protrusion and an indentation. Due to the recess in the dielectric layer 116 between the adjacent positive electrode 112 and the negative electrode 114, the total area for the fluorescent layer 122 coated on the dielectric layer 116 and the top surface 108 of the rear plate 102 is effectively increased to increase the luminous efficiency of the plasma panel 100.

Figure 5:
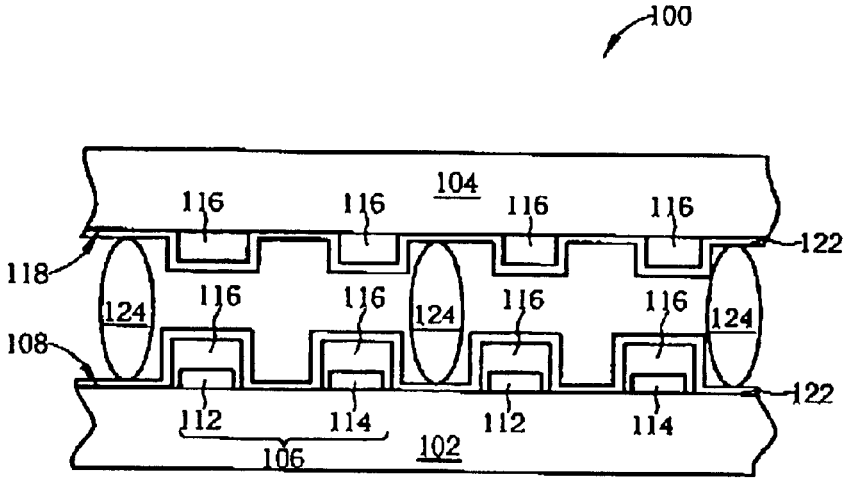
FIG. 5 is a cross-sectional diagram of a plasma panel according to the present invention.

Referring back to FIG. 2, a protrusion height of the dielectric layer 116 is smaller than a height of the spacers 124 so that the transmittance of the plasma panel 100 is not affected. In addition, the dielectric layer 116 having the predefined pattern is usually formed by a screen printing method. However, the method for forming the dielectric layer 116 is not limited to this, other methods being able to achieve the same result, such as deposition followed by etching, may be utilized to form the dielectric layer 116 having the predefined pattern. Furthermore, recesses are formed in the dielectric layer 116 disposed on the top surface 108 of the rear plate 102, according to this preferred embodiment of the present invention, to increase the coating area for the fluorescent material, so as to increase the luminous efficiency of the plasma panel 100. In the present invention, the electrodes may be disposed on the bottom surface 118 of the front plate 104 and covered by a dielectric layer (not shown) having recesses to increase the coating area for the fluorescent material. Or the electrodes may be disposed on the bottom surface 118 of the front plate 104 or the top surface 108 of the rear plate 102, and the dielectric layer 116 having recesses are disposed on both the top surface 108 of the rear plate 102 and the bottom surface 118 of the front plate 104 (as shown in FIG. 5) to increase the coating area for the fluorescent material so as to increase the luminous efficiency of the plasma panel. In these two cases, the dielectric layer having a predefined pattern (116) needs to be disposed on the bottom surface 118 of the front plate 104 before coating the fluorescent layer 122.

Figure 4:
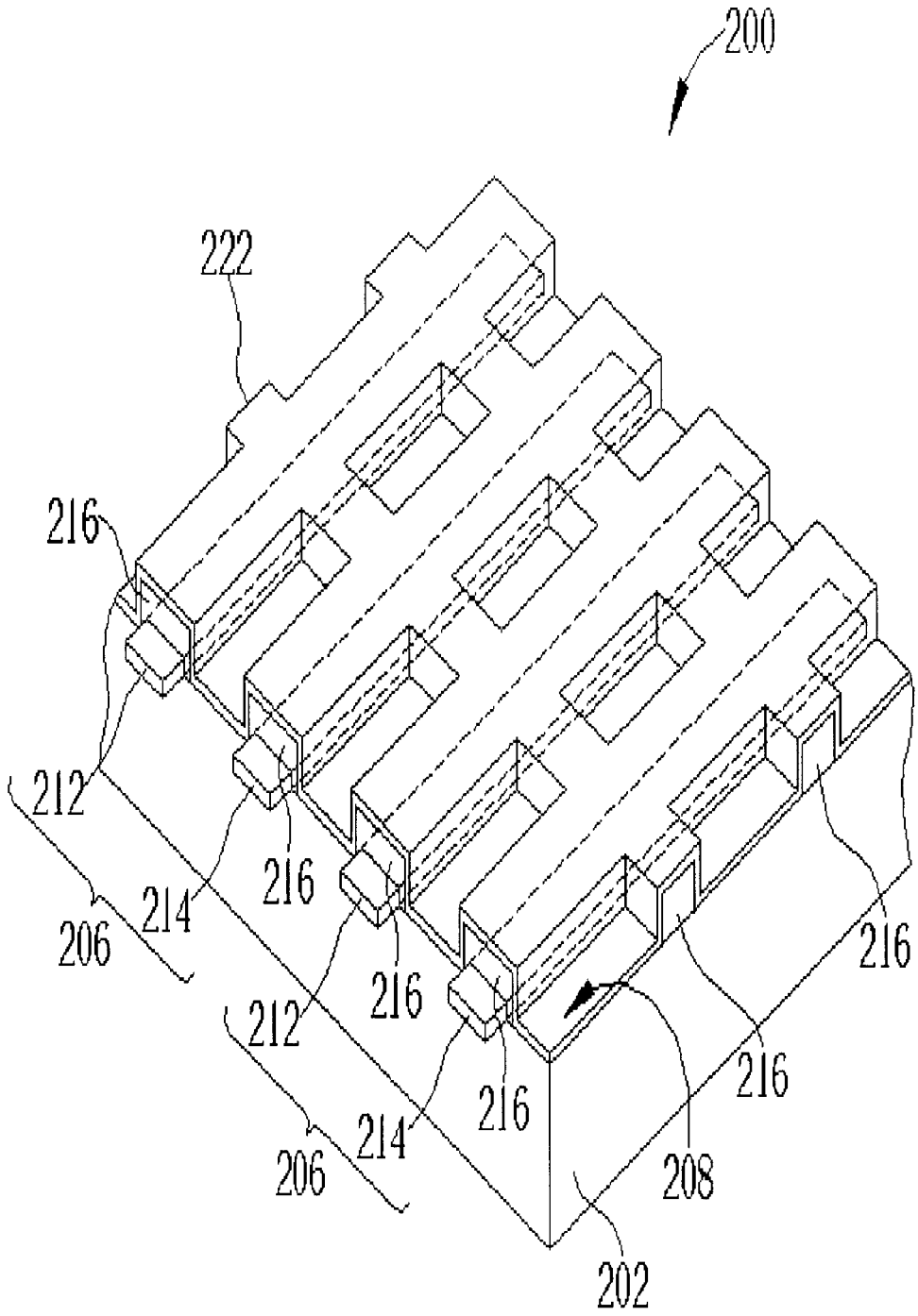
FIG. 4 is a top view of a plasma panel according to a second preferred embodiment of the present invention.

Referring to FIG. 4. FIG. 4 is a top view of a plasma panel 200 according to a second preferred embodiment of the present invention. As shown in FIG. 4, the present invention plasma panel 200 comprises a rear plate 202 and a front plate (not shown) disposed parallel with and spaced apart from the rear plate 202. Since the structure of the front plate (not shown) in this preferred embodiment of the present invention is the same as the structure of the front plate 102 in the first preferred embodiment of the present invention, it is not mentioned redundantly. A plurality of electrode pairs 206 are disposed on a top surface 208 of the rear plate 202. Each electrode pair 206 comprises a positive electrode 212 and a negative electrode 214. The positive electrode 212 and the negative electrode 214 of each electrode pair 206 are spaced equally, and a discharge gap is formed between the positive electrode 212 and the negative electrode 214 of each electrode pair 206.

A dielectric layer 216 having a predefined pattern is disposed on the top surface 208 of the rear plate 202 to cover the electrode pairs 206 so as to protect and isolate the electrode pairs 206. A fluorescent layer 222, usually being a phosphorous layer, is coated on both the top surface 208 of the rear plate 202 and a surface of the dielectric layer 216. A plurality of spacers (not shown) are disposed between the front plate (not shown) and the rear plate 202 to maintain the fixed spacing between the front plate (not shown) and the rear plate 202. In addition, a discharging gas is filled between the front plate (not shown) and the rear plate 202 to generate grow discharge when a voltage is applied between the positive electrode 212 and the negative electrode 214. The discharging gas is an inert gas, such as helium (He), neon (Ne), argon (Ar), etc, or a mixed gas of these inert gases.

Different from the first preferred embodiment of the present invention, not only does the dielectric layer 216 in the second preferred embodiment of the present invention, presenting in a sequence of a protrusion and an indentation, not cover the positive electrode 212 and the negative electrode 214 levelly, but also a plurality of recesses are formed in the dielectric layer 216 between the adjacent positive electrode 212 and the negative electrode 214 to make the protrusions in the dielectric layer arranged in a matrix form. Owing to the plurality of recesses in the dielectric layer 216 between the adjacent positive electrode 212 and the negative electrode 214, the total area for the fluorescent material coated on the dielectric layer 216 and the top surface 208 of the rear plate 202 is effectively increased. Under the same condition, the luminous efficiency of the plasma panel 200 according to the second preferred embodiment is superior to the luminous efficiency of the plasma panel 100 according to the first preferred embodiment. Similarly, a protrusion height of the dielectric layer 216 is smaller than a height of the spacers (not shown) so that the transmittance of the plasma panel 200 is not affected.

The dielectric layer 216 having the predefined pattern is usually formed by a screen printing method. However, the method for forming the dielectric layer 216 is not limited to this, other methods being able to achieve the same result, such as deposition followed by etching, may be utilized to form the dielectric layer 216 having the predefined pattern. Furthermore, recesses are formed in the dielectric layer 216 disposed on the top surface 208 of the rear plate 202, according to this preferred embodiment of the present invention, to increase the coating area for the fluorescent material so as to increase the luminous efficiency of the plasma panel 200. In the present invention, the electrodes may be disposed on a bottom surface (not shown) of the front plate (not shown) and covered by a dielectric layer (not shown) having recesses to increase the coating area for the fluorescent material. Or the electrodes may be disposed on the bottom surface (not shown) of the front plate (not shown) or the top surface 208 of the rear plate 202, and the dielectric layer 216 having recesses are disposed on both the top surface 208 of the rear plate 202 and the bottom surface (not shown) of the front plate (not shown) to increase the coating area for the fluorescent material so as to increase the luminous efficiency of the plasma panel. In these two cases, the dielectric layer having a predefined pattern (not shown) need to be disposed on the bottom surface (not shown) of the front plate (not shown) before coating the fluorescent layer 222.

Actually, the predefined pattern in the dielectric layer of the present invention plasma panel may be random figures. That means, the recesses in the dielectric layer are in any shape and in any dimensions, and the number of recesses is variable. The above-mentioned embodiments are two concrete and feasible examples and the present invention is not limited to these two embodiments.

Since the present invention plasma panel adapts the dielectric layer having the predefined pattern, the coating area for the fluorescent material is greatly increased due to the recesses in the dielectric layer. Therefore, both the luminous efficiency and the brightness of the plasma panel are increased. When applying the present invention plasma panel to a practical production line, the display having a high efficiency, high brightness, and low cost is fabricated.

As compared to the prior art plasma panel, the present invention plasma panel adapts the dielectric layer having the predefined pattern. The coating area for the fluorescent material is thus increased greatly due to the recesses in the dielectric layer to improve the luminous efficiency of the plasma panel. As a result, not only is the brightness of the plasma panel improved, but also the brightness of the display is improved to provide extra design flexibility and manufacturing flexibility to other components in the display. In addition, the problem of cost is not incurred owning to material replacement.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma panel comprising:

a rear plate;

a front plate parallel to and spaced apart from the rear plate by a plurality of spacers;

a plurality of electrode pairs parallel to each other and disposed over the rear plate; and a first dielectric layer having a first predefined pattern covering the plurality of electrode pairs, wherein a recess is formed between two adjacent electrodes of the plurality of electrode pairs; and a first fluorescent layer covering the first dielectric layer.

2. The plasma panel of claim 1, wherein the spacing between two adjacent electrodes the plurality of electrode pairs has an equal spacing.

3. The plasma panel of claim 1, further comprising a second fluorescent layer disposed over a surface of the front plate, wherein the surface of the front plate faces the rear plate.

4. The plasma panel of claim 3, further comprising a second dielectric layer having a second predefined pattern, sandwiched between the front plate and the second fluorescent layer.

5. The plasma panel of claim 1, wherein the first dielectric layer covers a partial surface of the rear plate between two adjacent electrodes of the plurality of electrode pairs, and the first fluorescent layer covers the first dielectric layer and the rear plate between the two adjacent electrodes of the plurality of electrode pairs.

6. The plasma panel of claim 5, further comprising a third dielectric layer having a third predefined pattern, disposed between the two adjacent electrodes of the plurality of electrode pairs and sandwiched between the first fluorescent layer and the rear plate.

7. The plasma panel of claim 6, wherein the third dielectric layer comprises at least one protrusion.

8. The plasma panel of claim 6, further comprising a third fluorescent layer disposed over a surface of the front plate, wherein the surface of the front plate faces the rear plate.

9. The plasma panel of claim 8, further comprising a fourth dielectric layer having a fourth predefined pattern, sandwiched between the front plate and the third fluorescent layer.

10. The plasma panel of claim 1 wherein the first fluorescent layer is a phosphorous layer.

11. The plasma panel of claim 3, wherein the second fluorescent layer in a phosphorous layer.

12. The plasma panel of claim 8, wherein the third fluorescent layer in a phosphorous layer.

13. The plasma panel of claim 1, wherein a discharge gap is formed between two adjacent electrodes of the plurality of electrode pairs.

14. A plasma panel comprising:

a rear plate;

a front plate parallel to and spaced apart from the rear plate by a plurality of spacers;

a plurality of electrode pairs parallel to each other and disposed over a surface of the front plate, wherein the surface of the front plate faces the rear plate;

a dielectric layer having a predefined pattern covering the plurality of electrode pairs, wherein a recess is formed between two adjacent electrodes of the plurality of electrode pairs; and a fluorescent layer covering the dielectric layer.

* * * * *